US006575614B2

(12) United States Patent
Tosco et al.

(10) Patent No.: US 6,575,614 B2
(45) Date of Patent: Jun. 10, 2003

(54) BEARING SYSTEM FOR A SAND CONTAINER TO BE VIBRATED IN A LOST FOAM CASTING APPARATUS

(75) Inventors: Bartolomeo Tosco, Almese (IT); Luigi Villani, Grugliasco (IT)

(73) Assignee: Fata Aluminium division of Fata Group S.p.A., Turin (IT)

( * ) Notice: Subject to any disclaimer, the term of this patent is extended or adjusted under 35 U.S.C. 154(b) by 72 days.

(21) Appl. No.: 09/850,169

(22) Filed: May 8, 2001

(65) Prior Publication Data

US 2001/0043764 A1 Nov. 22, 2001

(30) Foreign Application Priority Data

May 9, 2000 (EP) ..... 00830338

(51) Int. Cl.[7] ..... B01F 11/00
(52) U.S. Cl. ..... 366/114; 384/42
(58) Field of Search ..... 366/108, 110–114, 366/124, 208–211; 384/42; 164/39, 203, 206, 260, 261, 416, 478

(56) References Cited

U.S. PATENT DOCUMENTS 4,299,692 A * 11/1981 Musschoot
4,600,046 A * 7/1986 Bailey et al.
4,859,070 A 8/1989 Musschoot
5,067,549 A * 11/1991 Musschoot
6,149,292 A * 11/2000 Degrande

FOREIGN PATENT DOCUMENTS

JP 5-309445 * 11/1993

* cited by examiner

*Primary Examiner*—Charles E. Cooley
(74) *Attorney, Agent, or Firm*—Sughrue Mion, PLLC

(57) ABSTRACT

Bearing members project upwardly from a vibrating table with frusto-conical surfaces tapering upwardly to engage in corresponding frusto-conical sockets disposed in the bottom of a container of sand to be compacted. The frusto-conical sockets are formed of a material resistant to wear. The bearing members each comprise a body of wearable material which forms the frusto-conical surface. Each wearable body is fixed to the vibrating table by a respective releasable fastening element elongated in a vertical direction and having an upper head shaped to transmit and distribute a compression pre-load into the body.

12 Claims, 2 Drawing Sheets

BEARING SYSTEM FOR A SAND CONTAINER TO BE VIBRATED IN A LOST FOAM CASTING APPARATUS

BACKGROUND OF THE INVENTION

The present invention relates to a bearing system for a sand container to be vibrated on a vibrating table in a lost foam casting apparatus. In particular, the invention relates to a bearing system for a sand container to be vibrated on a vibrating table in a lost foam casting installation, the system comprising a plurality of bearing members projecting upwardly from the vibrating table, each bearing member having an upwardly tapered frusto-conical surface, and a corresponding plurality of frusto-conical bearing sockets on the bottom of the container. A bearing system of this type is described in U.S. Pat. No. 4,859,070.

As is known, the lost foam casting technique is a foundry technique based essentially on the production of a polystyrene (or similar material) pattern which reproduces the characteristics of the piece to be made. The pattern is introduced into a container filled with sand which, by means of vibration, is distributed and compacted in such a way as intimately to closely reproduce the shape of the pattern. Subsequently, hot casting material (typically molten metal) is poured into the space occupied by the pattern. The casting material dissolves the pattern and occupies the space previously occupied thereby within the sand. The final result is a casting, and thus a workpiece, the shape of which copies exactly the shape of the pattern.

Conventional systems for compacting sand involve either vibration means generating a vertical movement (which due to the shape of the coupling surfaces between the vibrating table and the container are in part transformed into horizontal movement), or vibrating means which generate a rotary motion about a vertical axis. Both systems have been found to have serious limitations of use due to the fact that the ever more complex shape of the patterns to be invested by the sand has lead to the need for an increase in the vibrational stresses.

Conventional vibration systems impose accelerations of several g (3–4) onto a unit the overall weight of which, including the container full of sand and the vibrating table, is about 2000–2500 kg. In these conditions, with casting of particularly complex shapes, the time necessary for vibration to fill the internal cavities of the foam pattern can be 2–3 minutes; extending the vibration time considerably increases the risk of deformation of the surfaces of the polystyrene patterns.

SUMMARY OF THE INVENTION

One object of the present invention is to provide a container bearing system adapted to operate correctly when the vibrating table has very much higher accelerations imparted to it, for example of the order of 10–15 g, for the purpose of reducing the vibration times and avoiding the risk that the surfaces of the pattern become deformed, and to improve the compaction of the sand and therefore the efficiency of the installation.

Another object of the invention is to reduce the wear on the bottom of the container and the associated expenses inherent in the maintenance of containers, as well as to extend the useful life of the containers themselves, especially when these are subject to high operating accelerations.

A particular object of the invention is to provide a system comprised of bearing members able to withstand shock caused by the bottom of the container without breaking.

A further object of the invention is to prevent premature wear of the bearing surfaces between the bottom of the container and the vibrating table.

BRIEF DESCRIPTION OF THE DRAWINGS

The invention will now be described, purely by way of non-limitative example, making reference to the attached drawings, in which.

DETAILED DESCRIPTION OF THE INVENTION

Making reference to the drawings, numeral 10 indicates a horizontal vibrating table coupled to an underlying vibrating unit (not shown) able to impose on the table vertical vibrational stresses with high accelerations, for example of the order of 10–15 g. The vibrating unit is not relevant in itself for the purposes of understanding the invention and therefore will not be described here.

Figure 1:
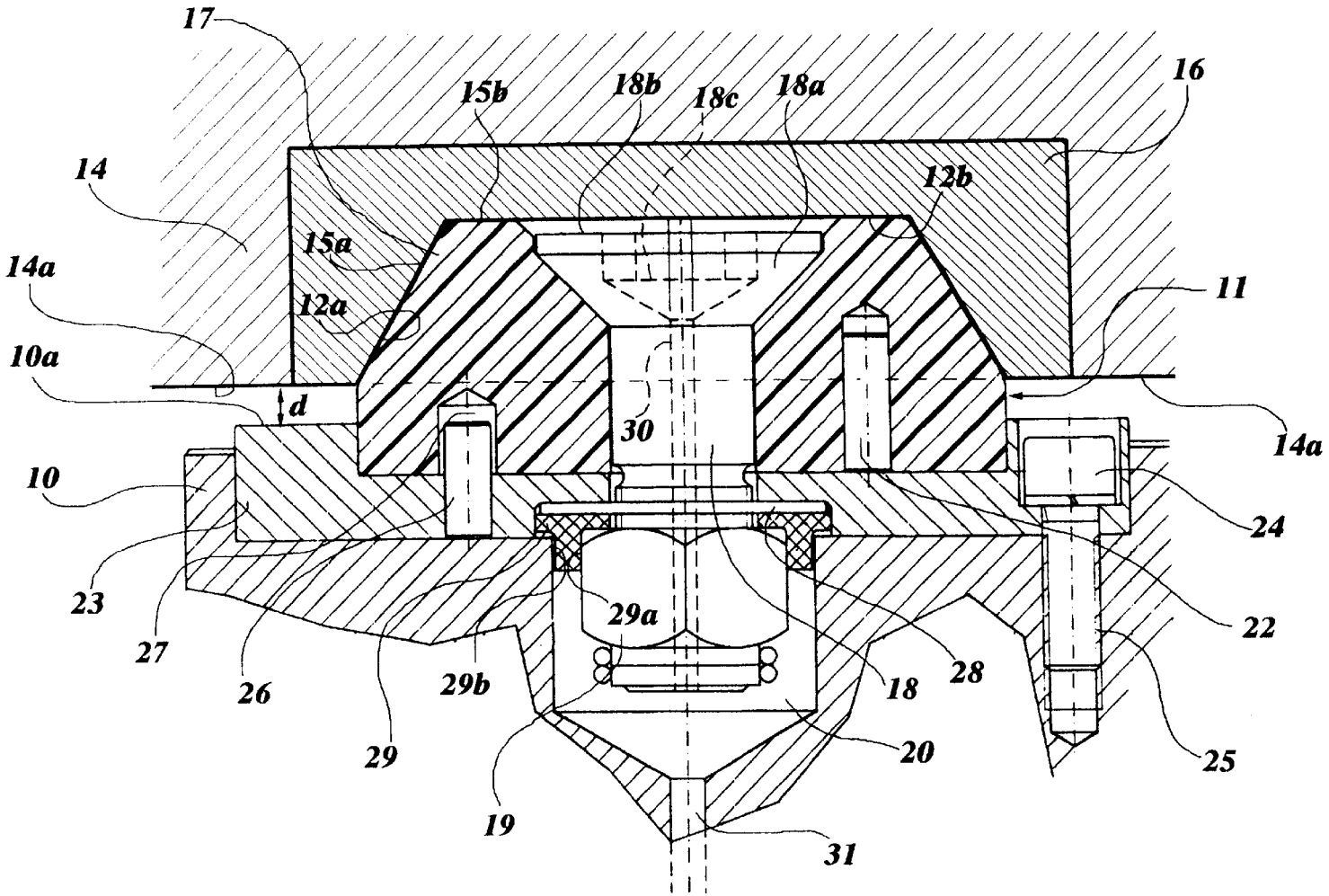
FIG. 1 is a view, partially in vertical section, of the bearing zone between the bottom of a container of sand to be compacted and a vibrating table.

From the upper surface of the vibrating table 10 project a plurality of bearing pin members, one of which is illustrated in FIG. 1 as generally indicated with reference numeral 11. There are usually provided three bearing pin members angularly spaced by 120° from one another on the table 10 and each having a frusto-conical surface 12*a* tapered upwardly and terminating with a flat horizontal upper face 12*b*.

The bottom of the container 14, containing sand to be compacted about a polystyrene pattern (not illustrated) has a corresponding plurality of frusto-conical bearing sockets 15 in which can be seen a lateral frusto-conical portion 15*a* tapered upwardly and a flat horizontal upper face portion 15*b*.

The surfaces 15*a* and 15*b* of the frusto-conical socket 15 couple in a congruent manner with the respective lateral frusto-conical surfaces 12*a* and upper horizontal surfaces 12*b* of the pin members 11 in such a way that the container is bearinged solely by the pin members 11 without the bottom of the container coming into contact with the upper surface of the table. In rest conditions, as shown in FIG. 1, a vertical space d is left between the lower surface 14*a* of the container and the upper surface 10*a* of the vibrating table 10 in such a way that direct contact between the vibrating table and the bottom of the container is prevented.

According to the present invention one of the frust-conical surfaces 12*a* and 15*a* intended to come into contact by impact during the operation of the vibrating table is made of a wearable material whilst the other is made of a material resistant to wear. In the preferred embodiment the frusto-conical surface 12*a* and the upper face 12*b* of the bearing pin member 11 are formed of a wearable material, for example polyether-ether-ketone or other plastics material nevertheless having appreciable characteristics of mechanical strength and resistance to abrasion and high temperatures. The socket 15 on the bottom of the container is on the other hand made of a material having very high resistance to wear and may be, for example, 38NCD4 induction tempered steel with a surface hardness value of the order of 55–60 HRC.

In the preferred embodiment, whilst the bottom part of the container 14 is generally of normal Fe 37 steel, the portion of the bottom in which the frusto-conical sockets 15 are formed comprises an insert 16 welded into the bottom of the container and made of induction tempered steel having the above-mentioned hardness characteristics.

Each of the bearing pin members 11 comprises a body 17 of wearable plastics material fixed in a releasable manner to the vibrating table by means of a bolt element 18 disposed centrally in the wear body 17 and elongated in the vertical direction. The bolt fastening element has a head 18*a* widening toward the upper face 12*b* of the body 17 and tapered towards the bottom in an essentially frusto-conical shape to transmit and distribute throughout the plastics body 17 a compression pre-load which reduces the risks of breakage of the wear body 17 as will be explained better hereinafter. The head 18*a* of the bolt element 18 has a downwardly tapered conical shape with an upper face 18*b* of width less than but comparable to the upper face 12*b* of the bearing member 11 for the purpose of distributing the compression forces substantially throughout the entirety of the wear body 17. In a particularly preferred embodiment the frusto-conical surface of the head 18*a* has a slope of about 45 degrees with respect to a horizontal plane.

The bolt element 18 co-operates with an opposing element fixed to the vibrating table 10. In the preferred embodiment this contrast/opposing element comprises a nut 19 received in a seat 20 formed in the vibrating table 10. Alternatively, in a less preferred and not illustrated embodiment, the fastening element 18 could be a screw engageable in a threaded seat formed in the vibrating table 10.

Within the plastics body 17 there is provided a plurality of rigid reinforcement elements 22 disposed parallel to the bolt element 18 and angularly spaced about it. In the embodiment illustrated here the reinforcement elements 22 are metal pins which extend vertically in the wear body 17 of the bearing member 11 and which essentially serve to absorb shear stresses, but in part also the tension stresses which are generated in the member 11 when the vibrating table is in operation.

As illustrated in the drawings, in the preferred embodiment the bolt element 18 is not directly fixed to the vibrating table but to an intermediate plate 23, which is mounted removably to the vibrating table 10 by means of a plurality of releasable fastening elements 24 disposed around the periphery and which engage in threaded seats 25 formed in the body of the vibrating table 10.

A reference pin 26 projects upwardly from the intermediate plate 23, which pin is received in a corresponding blind hole 27 formed in the lower face of the plastics body 17 for the purpose of resisting the rotation of the body 17 when the bolt 18 is tightened, for example when using an Allen key in a suitable cavity 18*c* formed in the head 18*a* of the bolt element 18.

The intermediate plate 23 is removable to allow a cup spring or Bauer spring 28 and an engagement block 29 to be fitted to the bolt 18.

The engagement block 29 has an inner lateral surface 29*a* and an outer lateral surface 29*b* both of non-circular shape which serve to couple respectively with the inner surface of the cavity 20 and with the nut 19 in such a way as to prevent rotation of this latter when it is desired to effect tightening or releasing of the bolt by acting externally on the cavity 18*c* by means of a suitable tool.

Still according to the invention, through the bearing member, in particular through the bolt element 18, there is formed an internal passage 30 for conveying a stream of compressed air into the contact region of the frusto-conical surfaces 12*a* and 15*a* during operation of the vibrating table. The air stream serves to keep dust and grains of sand away from the interface between the frusto-conical surfaces, which could accelerate the wear of the plastics body 17. As is known, in fact, sand and dust are present in considerable quantities in the environment in which the vibrating table works for the compaction of the sand.

The compressed air provided through the passage 30 comes from a source of compressed air (not illustrated) which communicates with the various bearing members 11 through channels 31 formed in the vibrating table 10, which open into the cavities 20 in which the locking nut 19 is received.

Figure 2:
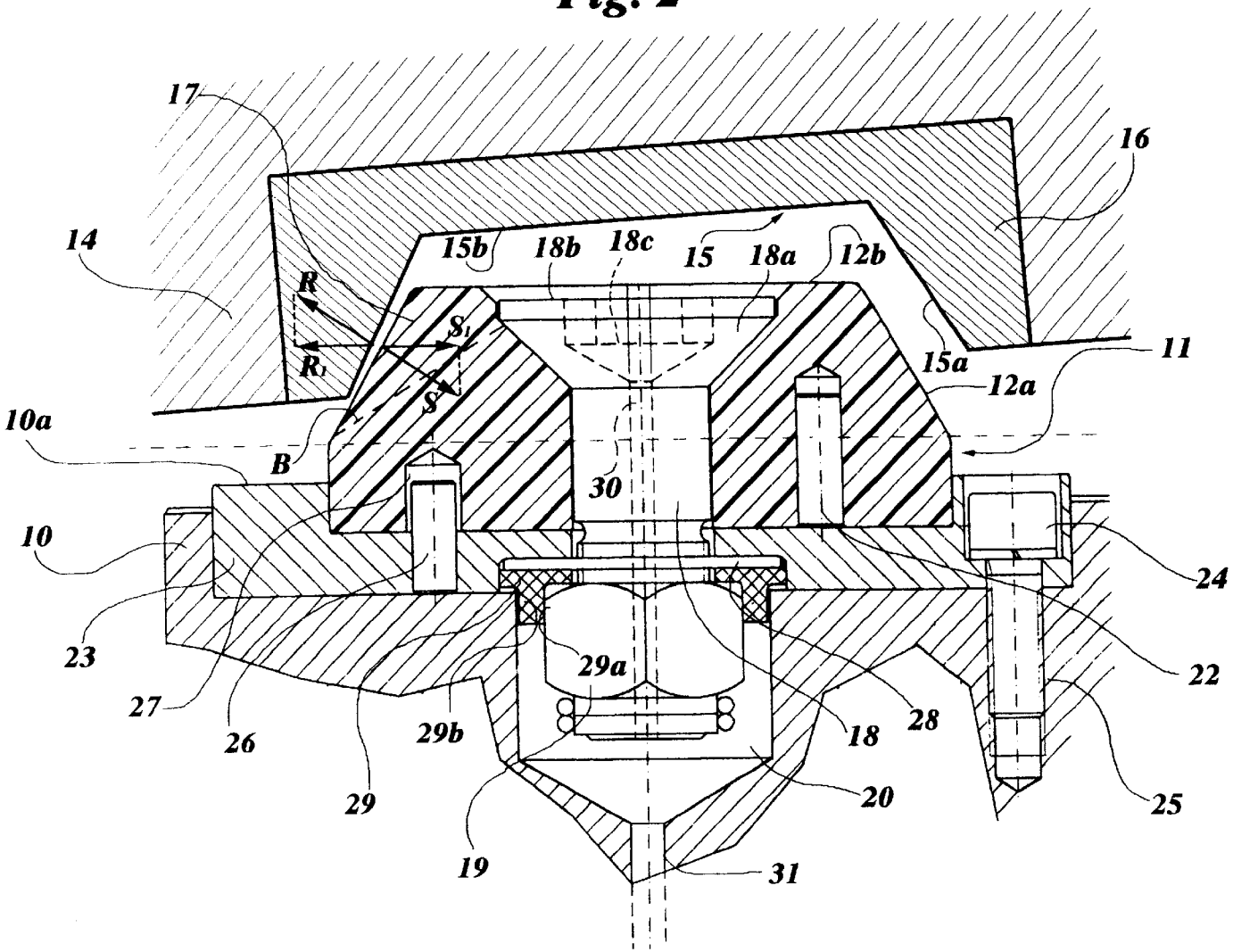
FIG. 2 is a view similar to FIG. 1 in an operating condition of the vibrating table.

During operation, because of the vibrations imparted by the vibrating table 10, the container is repeatedly thrust upwardly and downwardly impacting the bearing pin members 11. As illustrated in FIG. 2, during the descending movement of the container, the sockets 15 are not always perfectly aligned with the pins 11 so that the impacts occur on the frusto-conical surfaces 12*a* of the pin generating a stress S in the bearing member 11 having a horizontal component S' to which, in the container, there corresponds a horizontal equal and opposite reaction component R' which contributes to the compaction of the sand. The vertical pre-compression force produced by the bolt element 18 resists the creation of tension stresses in the wear element 17; moreover, the reinforcement pin elements 22 absorb shear and tension forces preventing the impact from causing partial breakage of the body 17 as indicated for example by a possible fracture line B.

Experimental tests have shown that excellent performance is obtained with polyether-ether-ketone wear bodies, which need to be replaced at intervals of two to three months. The engagement contrast block 29 makes it possible easily to remove and replace the body 17 acting from the outside with an Allen key without having to dismantle the intermediate plate 23 to resist rotation of the nut 19.

In the preferred embodiment the Bauer spring 28 (which in the figure is illustrated in a completely compressed condition) transmits to the bolt 18 tension stress which makes it possible to reduce the overload peaks on the bolt when the container descends onto the bearing member.

Naturally, the principle of the invention remaining the same, the details of construction and the embodiments can be widely varied with respect to those described and illustrated without by this departing from the ambit of the present invention as defined in the following claims.

What is claimed is:

1. A bearing system for a sand container to be vibrated on a vibrating table in a lost foam casting installation, the system comprising:

a plurality of bearing members projecting upwardly from the vibrating table, each bearing member having an upwardly tapered frusto-conical surface;

a corresponding plurality of frusto-conical bearing sockets on the bottom of the container;

wherein the frusto-conical sockets are formed in a material resistant to wear; and wherein the bearing members each comprise a body of wearable material which forms said frusto-conical surface, secured to the vibrating table by means of a respective releasable fastening element elongated in an essentially vertical direction and having an upper head shaped to transmit and distribute a compression pre-load into the body.

2. The system of claim 1, wherein the bearing member has an upper base surface and the fastening element has a head of downwardly tapered conical shape with an upper base with a width less than but comparable to a width of the upper base surface of the bearing member.

3. The system of claim 1, wherein a passage is formed, in correspondence with each bearing member, for conveying a stream of air into the region between the socket and the upper surface of the bearing member.

4. The system of claim 3, wherein the passages extend through the bearing members.

5. The system of claim 4, wherein the passages are formed in the fastening elements.

6. The system of claim 1, further including a plurality of rigid reinforcement elements which extend vertically in the wearable body of each bearing member.

7. The system of claim 6, wherein the reinforcement elements are distributed regularly throughout the wearable body.

8. The system of claim 1, wherein the fastening element comprises a bolt co-operating with a locking nut disposed under a plate removably mounted on the vibrating table.

9. The system of claim 1, wherein the sockets on the bottom of the container are formed of tempered steel.

10. The system of claim 9, wherein each of the sockets is formed in an insert of tempered steel fixed to the bottom of the container.

11. The system of claim 1, wherein the body of each bearing member is made of a material including polyether-ether-ketone.

12. The system of claim 1, wherein an elastic element is disposed between the vibrating table and each fastening element to stress said fastening element in tension.

* * * * *